US005888055A

United States Patent [19]

Lee

[11] Patent Number: 5,888,055

[45] Date of Patent: Mar. 30, 1999

[54] CONNECTION BETWEEN A REFRIGERANT PIPE AND A SUCTION MUFFLER OF A HERMETIC RECIPROCATING COMPRESSOR

[75] Inventor: Sung Tae Lee, Kyungki-do, Rep. of Korea

[73] Assignee: Samsung Electronics Co., Ltd., Suwon, Rep. of Korea

[21] Appl. No.: 892,309

[22] Filed: Jul. 14, 1997

[30] Foreign Application Priority Data

Jul. 12, 1996 [KR] Rep. of Korea ..... 1996 28250
Jun. 13, 1997 [KR] Rep. of Korea ..... 1997 24565

[51] Int. Cl.[6] ..... F04B 39/00

[52] U.S. Cl. ..... 417/312; 417/902; 184/6.24

[58] Field of Search ..... 417/312, 313, 417/540, 902; 418/DIG. 1; 184/6.24, 6.21

[56] References Cited

U.S. PATENT DOCUMENTS 863,607 8/1907 Holder ..... 417/540
5,252,035 10/1993 Lee ..... 417/312

*Primary Examiner*—Timothy S. Thorpe
*Assistant Examiner*—Cheryl J. Tyler
*Attorney, Agent, or Firm*—Burns, Doane, Swecker & Mathis, L.L.P.

[57] ABSTRACT

A hermetic reciprocating compressor comprises a hermetic casing and a compressing portion installed inside the casing. The compressing portion includes a cylinder, and a piston reciprocating inside the cylinder. A suction pipe transfers a mixture of compressible and incompressible media (e.g. gaseous refrigerant and lubricating oil) into the casing. A suction muffler has an inlet communicating with the suction pipe and an outlet connected to the compressing portion. A tubular spring has a first end portion of frusto-conical shape fitted into the inlet of the suction muffler so that a space is formed between the first end portion of the spring and the inlet of the suction muffler, and a second end portion connected to the suction pipe. Incompressible medium in the mixture is able to gravitate out of the suction muffler through the space, thereby preventing damage to internal parts of the compressing portion.

4 Claims, 5 Drawing Sheets

CONNECTION BETWEEN A REFRIGERANT PIPE AND A SUCTION MUFFLER OF A HERMETIC RECIPROCATING COMPRESSOR

BACKGROUND OF THE INVENTION

The present invention relates to a hermetic reciprocating compressor including a hermetic casing, a compressing portion having a cylinder and a piston reciprocating inside the cylinder and a motor for driving the piston.

A hermetic compressor is generally employed in a cooling system such as a refrigerator or an air conditioner, so as to compress a gaseous refrigerant received from an evaporator and supply the compressed refrigerant to a condenser.

FIGS. 3 and 4 show front and side sectional views of a conventional hermetic reciprocating compressor, respectively. As shown in the drawings, the conventional compressor includes a casing 101 forming a closed internal space, a driving motor 110 installed inside the casing 101 and a compressing portion 120 which is driven by the driving motor 110 to compress a refrigerant. The driving motor 110 includes a stator 112, a rotor 111 rotatably installed inside the stator 112 and a crank shaft 117 fitted into the rotor 111 and rotating therewith while supported within a support member member. The compressing portion 120 includes a cylinder 113, a piston 123 reciprocating inside the cylinder 113 and a cylinder head 127. The piston 123 is connected to an eccentric portion 119 of the crank shaft 117 by a connecting rod 121 and reciprocates inside the cylinder 113 according to a rotational movement of the rotor 111, thereby inhaling and compressing the refrigerant. A suction muffler 141 is installed on the cylinder head 127 to guide the refrigerant to be compressed into an internal space 125 of the cylinder 113. A suction pipe 129 for transferring the refrigerant from an evaporator (not shown) to the compressor is connected to the suction muffler 141 after passing through a wall of the casing 101.

Referring to FIG. 5, the suction muffler 141 has an internal space for receiving the refrigerant, an inlet 142 to which the suction pipe 129 is connected and an outlet which communicates with a refrigerant inlet 143 provided in the cylinder head 127. A coil spring 145 is installed between the inlet 142 of the suction muffler 141 and the suction pipe 129. One end of the coil spring 145 is fixedly inserted into the inlet 142 of the suction muffler 141 and the other end thereof is fitted outside the leading end of the suction pipe 129, so as to guide the refrigerant passing through the suction pipe 129 into the suction muffler 141.

The gaseous refrigerant from the evaporator flows into the suction muffler 141 via the suction pipe 129 and the coil spring 145, and is then supplied to the internal space 125 of the cylinder 113 through the cylinder head 127. On the other hand, the gaseous refrigerant supplied from the evaporator to the cylinder 113 contains liquid oil for lubrication and rust prevention for internal parts of the refrigerant circulation system. Since the refrigerant is vaporized in the evaporator by absorbing heat from the surroundings, whereas the oil maintains the liquid state due to its having a higher evaporation point than that of the refrigerant, the oil in the liquid state flows together with the gaseous refrigerant. The mixture of the liquid oil and the gaseous refrigerant contained in the internal space 125 of the cylinder 113 may damage the piston 123, the inner wall of the cylinder 113 or a valve plate (not shown) of the compressing portion 120, due to a liquid compression phenomenon of the liquid oil. Also, the liquid oil, having a relatively high specific volume, may obstruct the compression of the gaseous refrigerant, thereby decreasing the compression efficiency of the compressor.

SUMMARY OF THE INVENTION

It is an object of the present invention to provide a hermetic reciprocating compressor which is capable of removing liquid oil flowing together with a compressible medium at an inlet of a suction muffler of the compressor, to prevent damage of internal parts of the compressor and increase the compression efficiency of the refrigerant.

To accomplish the above object, there is provided a hermetic reciprocating compressor comprising:

a hermetic casing;

a compressing portion installed inside the casing and having a cylinder, and a piston reciprocating inside the cylinder;

a driving motor for reciprocating the piston;

a suction pipe for transferring a mixture of compressible and incompressible media into the casing;

a suction muffler having an inlet communicating with the suction pipe and an outlet connected to the compressing portion, for receiving the media mixture from the suction pipe; and a tubular spring having a first end portion fitted into the inlet of the suction muffler and having a smaller cross section than the inlet so that a space is formed between the first end portion of the spring and the inlet of the suction muffler, and a second end portion connected to the suction pipe, for guiding the mixture into the suction muffler, while allowing incompressible medium in the mixture to gravitate outwardly through the space.

Here, it is preferable that the diameter of the first end portion of the spring decrease toward the inlet of the suction muffler.

BRIEF DESCRIPTION OF THE DRAWINGS

The above object and advantages of the present invention will become apparent by describing in detail a preferred embodiment thereof with reference to the accompanying drawings in which.

DETAILED DESCRIPTION OF A PREFERRED EMBODIMENT OF THE INVENTION

Figure 1:
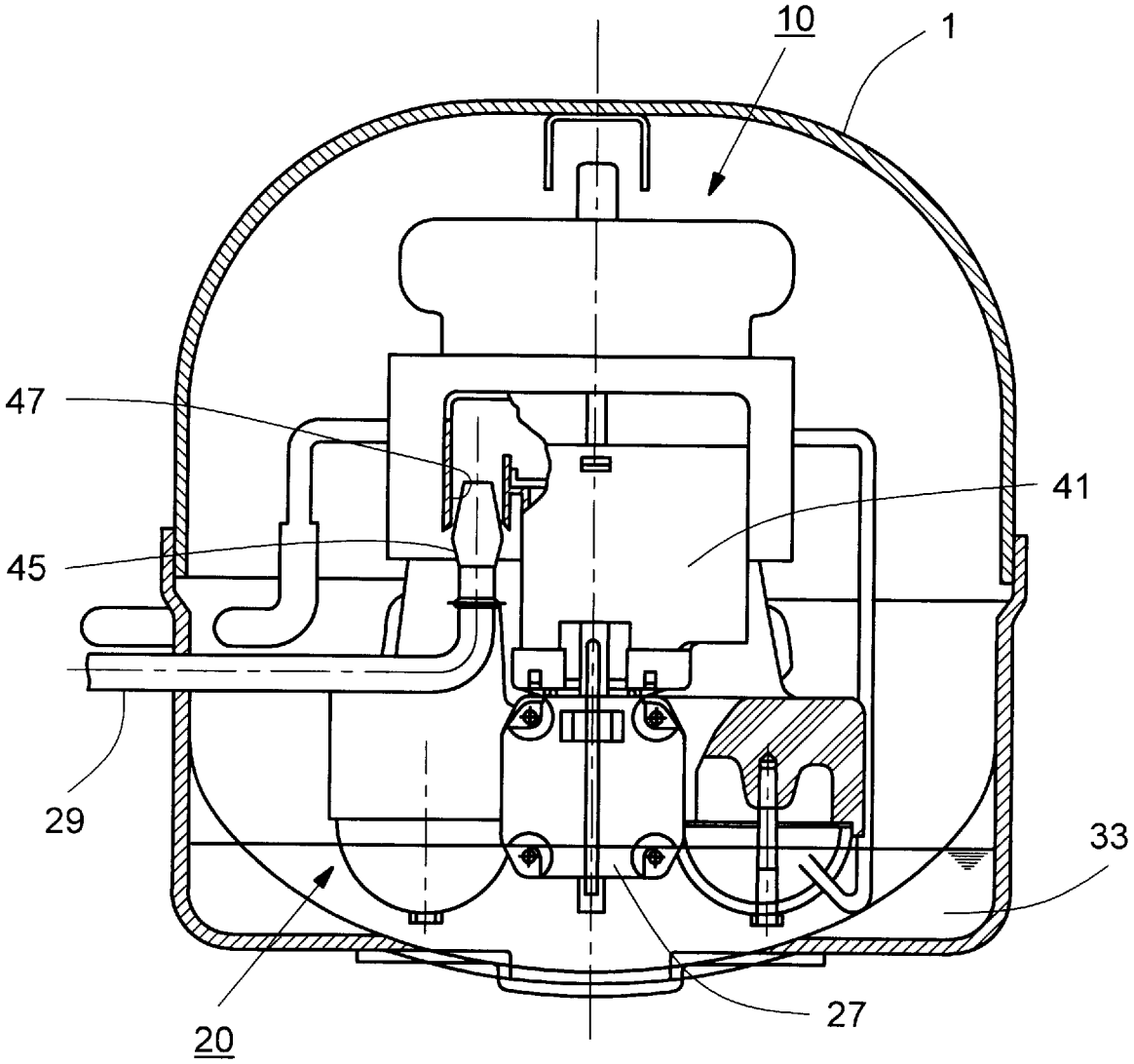
FIG. 1 is a vertical sectional view of a hermetic reciprocating compressor according to the present invention.
Figure 3:
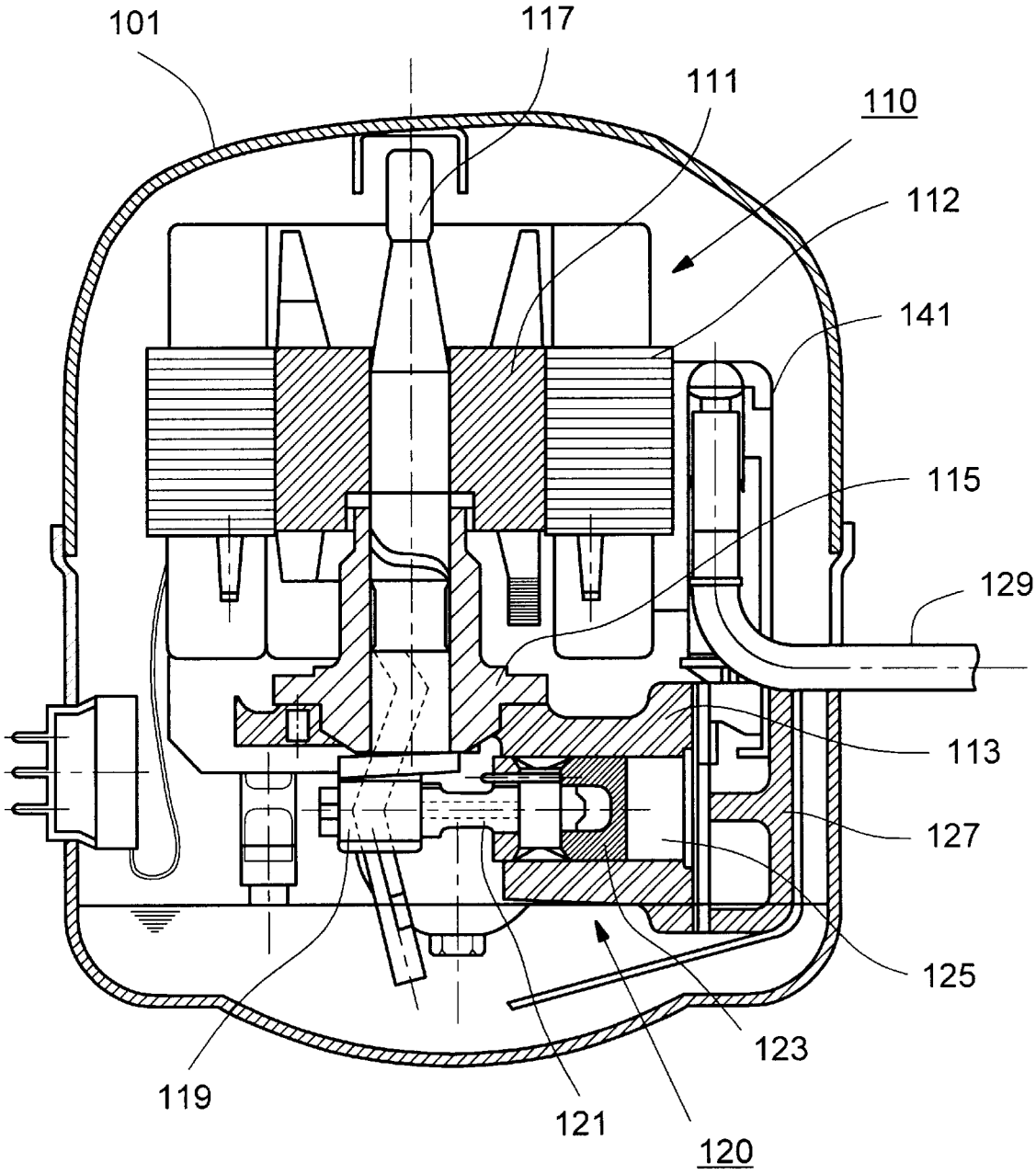
FIG. 3 (PRIOR ART)
FIG. 3 is a vertical sectional view of a conventional hermetic reciprocating compressor.
Figure 4:
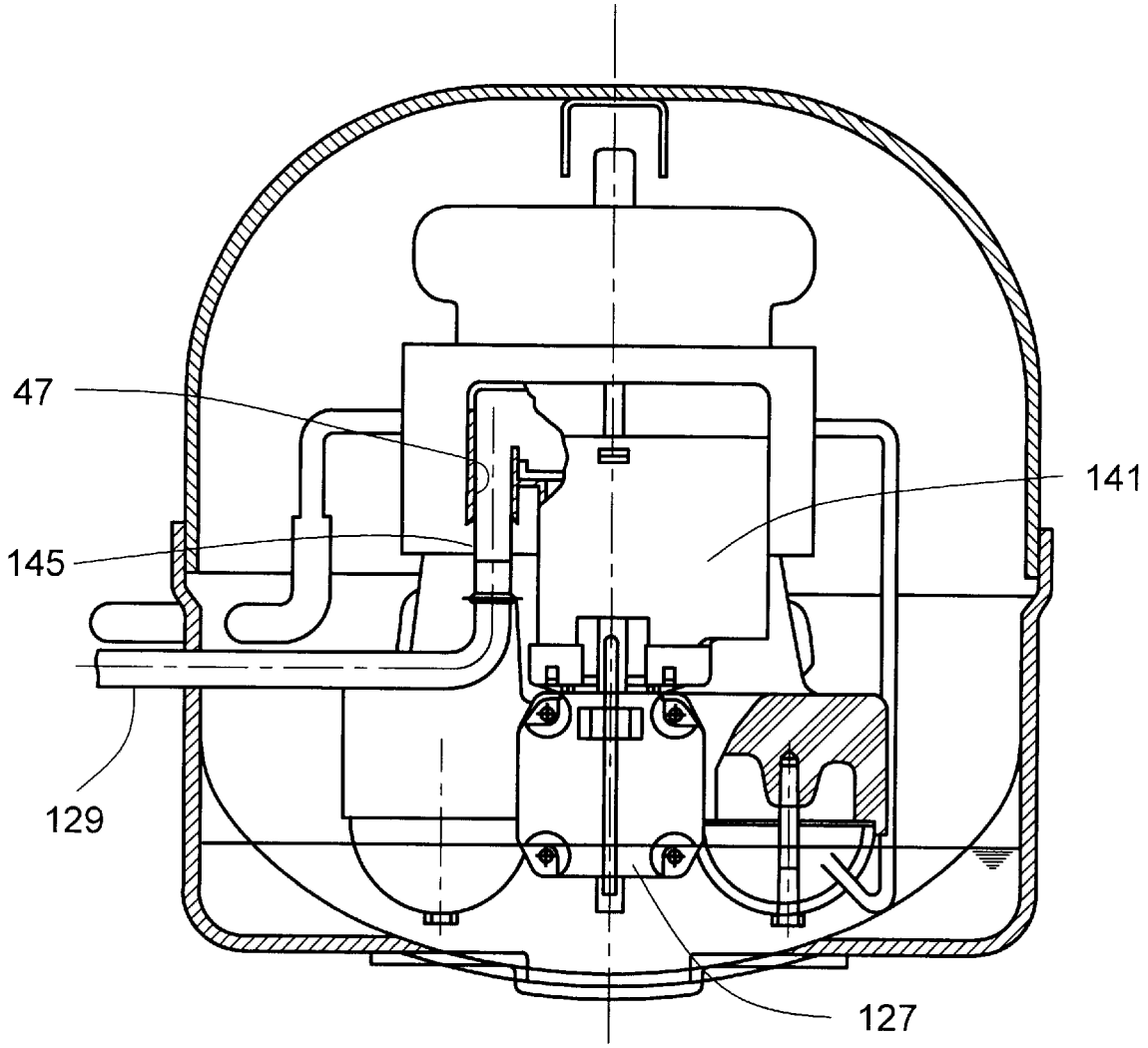
FIG. 4 (PRIOR ART)
FIG. 4 is another vertical sectional view of the conventional hermetic reciprocating compressor of FIG. 3.
Figure 5:
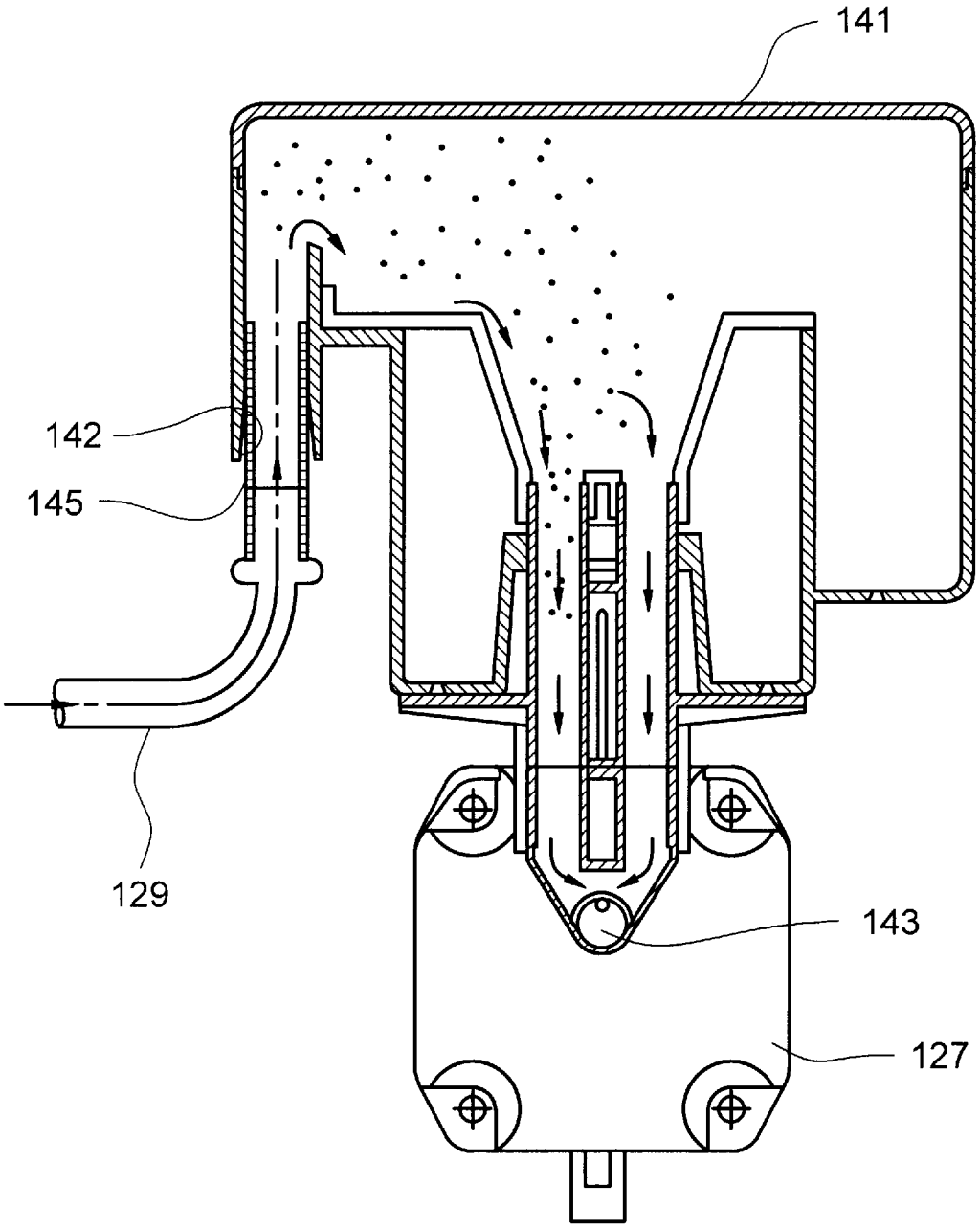
FIG. 5 (PRIOR ART)
FIG. 5 is an enlarged view of a conventional suction muffler of FIG. 4.

Referring to FIG. 1, a hermetic reciprocating compressor according to the present invention has a basic structure similar to the conventional reciprocating hermetic compressor as described with reference to FIGS. 3 and 4. Accordingly, a detailed description of the same elements as in the conventional compressor will be omitted.

As shown in FIG. 1, the compressor according to the present invention includes a casing 1 forming a closed internal space, a driving motor 10 installed inside the casing 1 and a reciprocating compressing portion 20. The compressing portion 20 includes a cylinder, a piston reciprocating inside the cylinder and a cylinder head 27 for closing one end of the cylinder. The piston is reciprocated inside the cylinder by the driving motor 10 to inhale a compressible medium such as a refrigerant contained in the cylinder and compress the medium. Lubricating oil 33 is contained at the bottom of the casing 1 and is picked up by an oil pickup device (not shown) and supplied to moving parts of the compressor.

A suction muffler 41 for supplying the refrigerant to the compressing portion 20 is connected to the cylinder head 27. A suction pipe 29 for transferring the refrigerant to the compressor is connected to an inlet 47 of the suction muffler 41. The suction pipe 29 is connected to an external evaporator (not shown) through a wall of the casing 1 to transfer the refrigerant from the evaporator to the inside of the casing 1.

Figure 2:
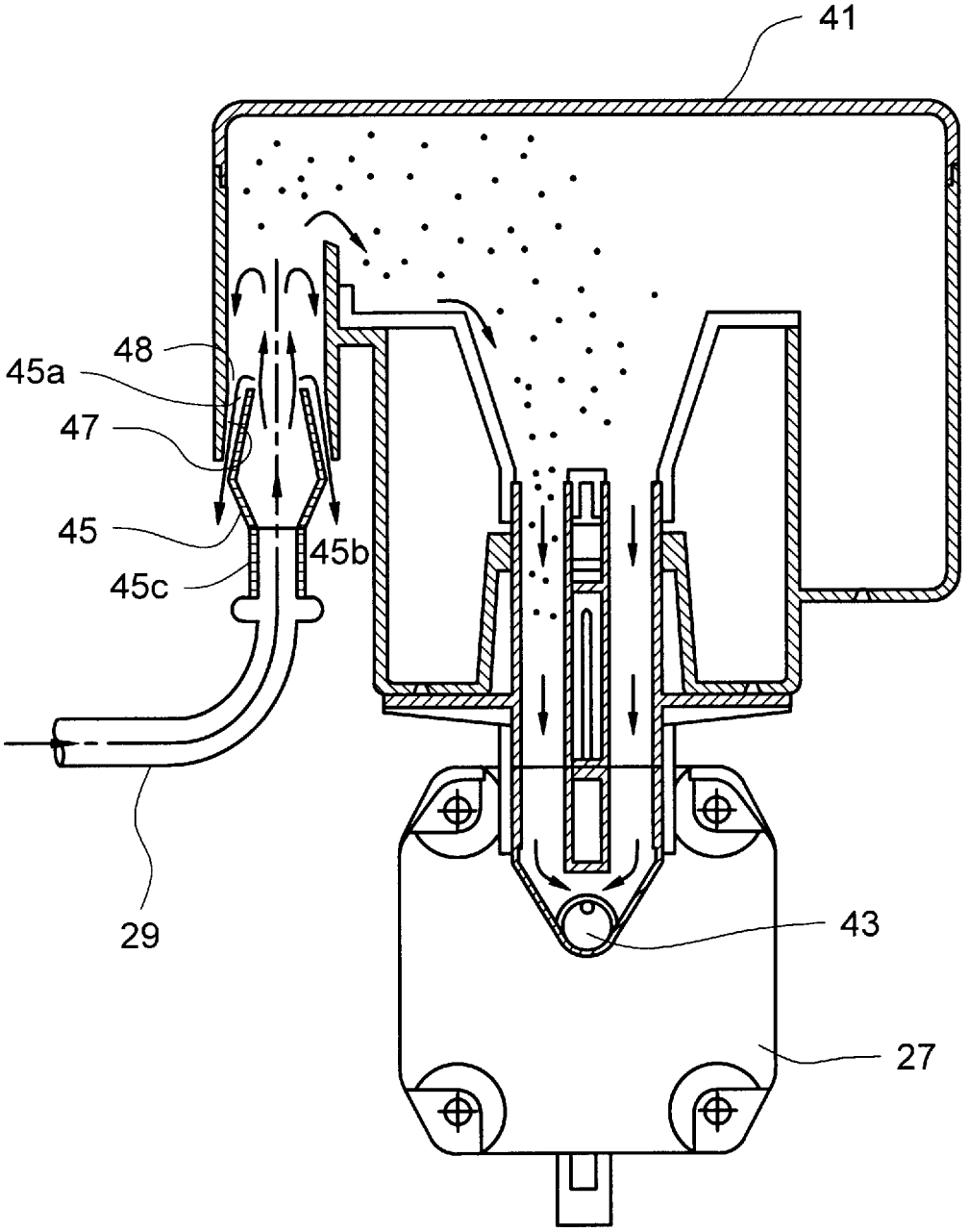
FIG. 2 shows an enlarged section of a suction muffler of FIG. 1.

Referring to FIG. 2, the suction muffler 41 is formed with an internal space for receiving the refrigerant, and has an outlet connected to a refrigerant inlet 43 of the cylinder head 27. The suction muffler 41 functions to temporarily contain the refrigerant supplied through the suction pipe 29 and then supply the refrigerant to the compressing portion 20.

The leading end of the suction pipe 29 is opened upwardly, and the inlet 47 of the suction muffler 41 is opened downwardly to communicate with the leading end of the suction pipe 29. A tubular coil spring 45 is disposed between the leading end of the suction pipe 29 and the inlet 47 of the suction muffler 41. The upper end of the coil spring 45 is inserted into the inlet 47 of the suction muffler 41, and the lower end thereof is fitted outside the leading end of the suction pipe 29. The cross section of the upper end of the spring 45 is smaller than the cross section of the inlet 47, so that a space or gap 48 is formed therebetween. Preferably, the upper portion or first end portion 45*a* thereof of the coil spring 45 has a frusto-conical shape, the diameter of which decreases upwardly, so that the space 48 is formed between the outer surface of the upper end portion of the coil spring 45 and the inner surface of the inlet 47 of the suction muffler 41. A second end portion of the spring 45 has a frusto-conical section 45*b* having a diameter decreasing away from the first end portion 45*a*, and a cylindrical section 45*c* mounted on the suction pipe.

In the above-described structure, while the mixture of gaseous refrigerant and liquid oil being transferred via the suction pipe 29 is passing through the coil spring 45, the gaseous refrigerant flows into the suction muffler 41 without resistance, while some of the oil adheres to the inner wall of the coil spring 45 due to the viscosity of the oil. That oil flows upwardly along the wall together with gaseous refrigerant and then, due to the presence of the space 48, is able, upon exiting the coil spring, to gravitate downwardly through the inlet 47. That is, the oil flows downward along the outer surface of the upper portion of the coil spring 45 due to its own weight and flows through the space 48 and into the bottom of the casing 1. This removal of oil is enhanced by the frusto-conical shape of the upper portion of the coil spring, because oil which would not otherwise contact the inner wall of the coil spring, will impact the decreasing diameter portion of that wall and adhere to it due to the oil viscosity, as noted above. Hence, the amount of oil which is removed will be increased by the shape of the coil spring wherein its diameter is gradually reduced in the upward direction.

Hence, most of the liquid oil is removed from the mixture of refrigerant gas and oil, thereby preventing the liquid compression phenomenon, to prevent damage of internal parts of the compressing portion such as a valve device and the piston, thereby enhancing the compression efficiency of the compressor.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A hermetic reciprocating compressor comprising:

a hermetic casing;

a compressing portion installed inside said casing and having a cylinder and a piston reciprocating inside said cylinder;

a driving motor for reciprocating said piston;

a suction pipe for transferring a mixture of compressible and incompressible media into said casing;

a suction muffler having an inlet communicating with said suction pipe and an outlet connected to said compressing portion, for receiving said mixture from said suction pipe; and a tubular spring having a first end portion fitted into said inlet of said suction muffler and having a smaller cross section than said inlet so that a space is formed between said first end portion of said spring and said inlet of said suction muffler, and a second end portion connected to said suction pipe, for guiding said mixture into said suction muffler, while allowing incompressible medium in said mixture to gravitate outwardly through said space, wherein a diameter of said first end portion of said spring decreases toward said inlet of said suction muffler.

2. The hermetic compressor as claimed in claim 1, wherein said first end portion has a frusto-conical shape.

3. The hermetic compressor as claimed in claim 2 wherein said second end portion includes a section with a frusto-conical shape having a diameter decreasing away from said first end portion.

4. The hermetic compressor as claimed in claim 3 wherein said second end portion further includes a cylindrical section extending from a smallest diameter of said frusto-conical section and mounted on said suction pipe.

* * * * *